United States Patent [19]

Haldemann et al.

[11] Patent Number: 4,657,277

[45] Date of Patent: Apr. 14, 1987

[54] SAFETY BINDING OF A BOOT ON A SKI

[75] Inventors: Gaston Haldemann, Fürigen; François Wirz, Saviese, both of Switzerland

[73] Assignee: Haldemann A.G., Stans, Switzerland

[21] Appl. No.: 666,221

[22] Filed: Oct. 29, 1984

[30] Foreign Application Priority Data

Nov. 1, 1983 [CH] Switzerland ..... 5903/83

[51] Int. Cl.[4] ..... A63C 9/08

[52] U.S. Cl. ..... 280/616; 280/624; 280/631; 280/634

[58] Field of Search ..... 280/613, 616, 618, 624, 280/627, 628, 634, 605, 633, 631

[56] References Cited

U.S. PATENT DOCUMENTS

| | | | |
|---|---|---|---|
| Re. 26,972 | 10/1970 | Spademan | 280/624 |
| 3,101,201 | 8/1963 | Hall | 280/616 |
| 3,560,011 | 2/1971 | Spademan | 280/624 |
| 4,153,886 | 3/1979 | Salomon | 280/624 |
| 4,268,064 | 5/1981 | Svoboda | 280/633 |
| 4,522,423 | 6/1985 | Haldemann et al. | 280/624 |
| 4,536,006 | 8/1985 | Haldemann et al. | 280/624 |
| 4,553,772 | 11/1985 | Boussemart et al. | 280/628 |

FOREIGN PATENT DOCUMENTS

| | | | |
|---|---|---|---|
| 0084813 | 8/1983 | European Pat. Off. | 280/624 |
| 0085313 | 8/1983 | European Pat. Off. | 280/624 |
| 1411638 | 8/1965 | France | 280/624 |
| 2021237 | 7/1970 | France | 280/624 |
| 2159480 | 6/1973 | France | 280/624 |
| 2420358 | 10/1979 | France | 280/624 |
| 506304 | 6/1971 | Switzerland | 280/624 |

*Primary Examiner*—John J. Love
*Assistant Examiner*—Eric D. Culbreth
*Attorney, Agent, or Firm*—Young & Thompson

[57] ABSTRACT

The present invention relates to a safety binding of a boot on a ski which comprises two lateral jaws (2) mounted for movement under the force of an elastic member (5) between a closed service position in which these jaws coact with the sole of the boot (C) and an open position. It also comprises structure (3) interacting with the heel of the ski boot and having a sole grip member (29) mounted for movement by the force of the same elastic member between a service position in which this member maintains the rear end of the sole of the boot on the ski and an open position, the whole being so arranged that the opening or the closing of the lateral jaws effects the opening or the closing respectively of the sole grip member, and vice versa.

4 Claims, 23 Drawing Figures

FIG. 5
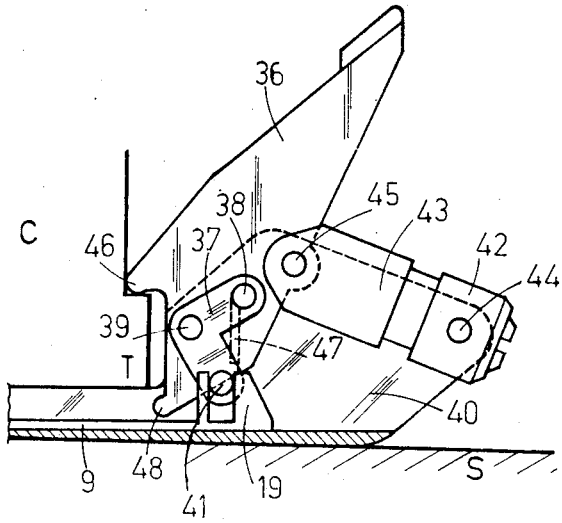
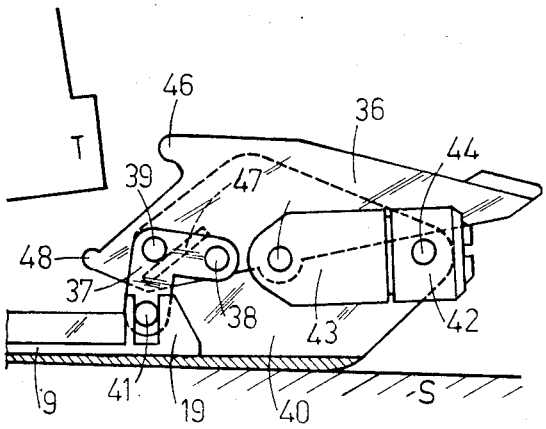
FIG. 6
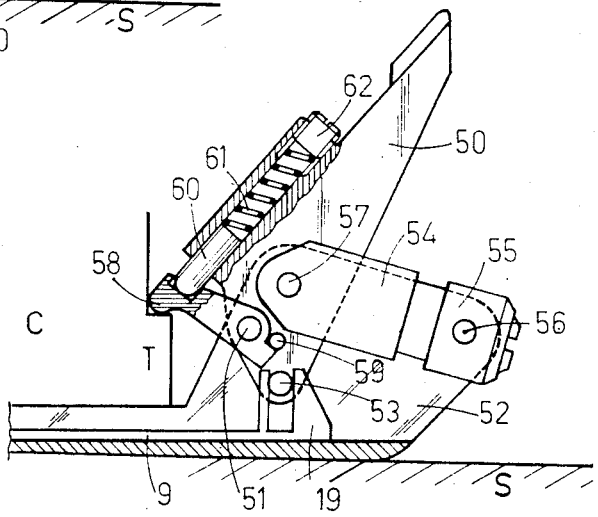
FIG. 7

SAFETY BINDING OF A BOOT ON A SKI

The present invention relates to a safety binding of a boot on a ski, and more particularly to a safety binding comprising particularly lateral jaws adapted to maintain in operative position the boot on a ski.

The principle of lateral jaw bindings has been known for several years, particularly from French patents FR No. 1,411,638 and FR No. 2,021,237, but until the present has not provided sufficiently reliable constructions to be commercialized. Improvements have been effected, for example to improve the disengagement of the boot in case of safety release of the binding, as described in patent FR No. 2,420,358, or even to improve the operation itself of this type of binding and to give it greater reliability in case of a fall, as disclosed in European patent applications of the same applicant namely EP No. 0 084 813 and EP No. 0 085 313.

Recent tests have shown that the distribution of the five principal causes of accidents due to the use of skis on snow is as follows:

Purely twisting fall: 14%
Purely forward fall: 22%
Combined twisting-forward fall: 43%
Combined twisting-rearward fall: 13%
Purely rearward fall: 8%

Existing commercial safety bindings with a forward abutment and a heel member are constructed to permit release of the boot in case of twisting and of forward fall, rearward fall being not at all or only poorly protected by possible disengagement.

It will therefore be seen that large risks are involved in combined falls of twisting in association with forward fall or rearward fall, these two risk factors alone representing almost 56% of the accidents. The reasons for these causes for accidents are due substantially to the parasitic scraping of the ends of the boot during the combined forward and twisting falls, the latter creating a supplemental twisting couple of the order of 3 to 4 mDan which is added to the torsional couple preadjusted by the binding abutment. Moreover, the transverse spiraling of the boot relative to the longitudinal axis gives rise, during combined falls, to wedging between the boot and the forward abutment jaws which also increases the torsional couple. The total couple thus produced reaches substantially the critical strength values of the leg of the skier. The same phenomenon is also present during combined reartwisting falls.

The object of the present invention therefore consists in providing a safety binding which overcomes the above drawbacks of the known safety bindings with a forward abutment and heel means, by creating conditions such that the binding is capable of completely neutralizing the supplemental torsional couple due to parasitic scraping and that the wedging effects due to spiraling of the boot in the forward abutment will be avoided.

This object is achieved by the safety binding of a boot on a ski, according to the invention, which comprises two lateral jaws mounted displaceably under the action of an elastic member between a closed service position in which the jaws coact with the sole of the boot and an open position, and which is characterized by the fact that it comprises heel means having a sole-gripping element mounted displaceably under the action of the same elastic member between a service position in which said element maintains the rear end of the sole of the boot on the ski and an open position, the whole being arranged so that the opening or closing of the lateral jaws effects the opening or the closing, respectively, of the sole-gripping element, and vice versa.

Thus, thanks to the mechanical connection of the two systems for securing the boot on the ski (comprising, in all, three bearing points), the combined forces exerted in case of a fall on the lateral jaws (torsion) and on the sole-grip (forward fall) act in the same direction and are additive so as to effect opening of the binding, the torsion couple being thus diminished and said opening facilitated by the combination of the two types of forces.

Moreover, this invention also has for its object a ski boot adapted to be secured to a ski by means of the safety binding defined above, and which is characterized by the fact that it comprises a sole having impressions coacting in the service position with the lateral jaws of the binding.

The accompanying drawings illustrate the invention schematically and by way of examples.

FIG. 1' shows a side view of a modified actuating lever.

FIGS. 5 and 6 are side views of a first modification of the heel means respectively in closed service position and in open position.

FIG. 7 is a side view of a second modification of the heel means in closed service position.

Figure 8:
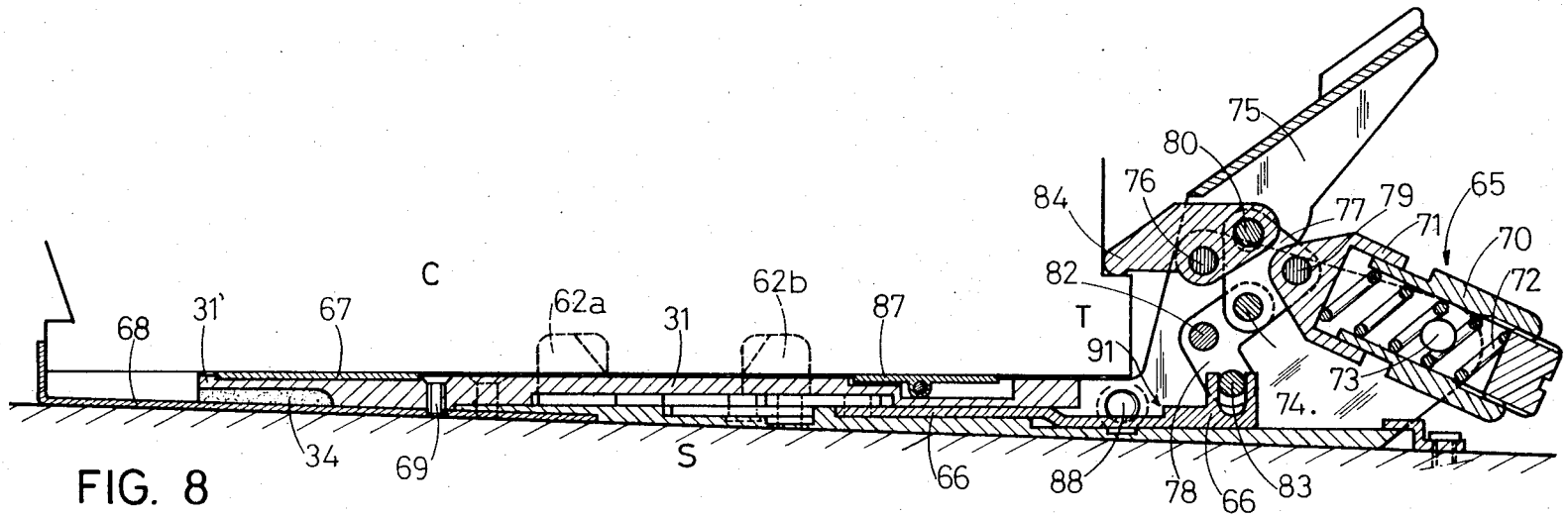
Figure 9:
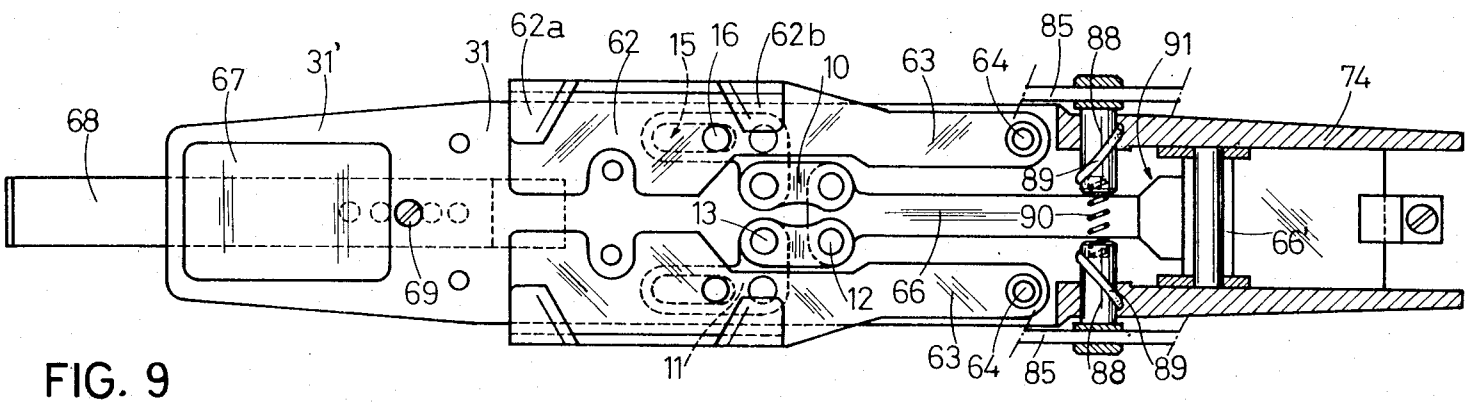
Figure 10:
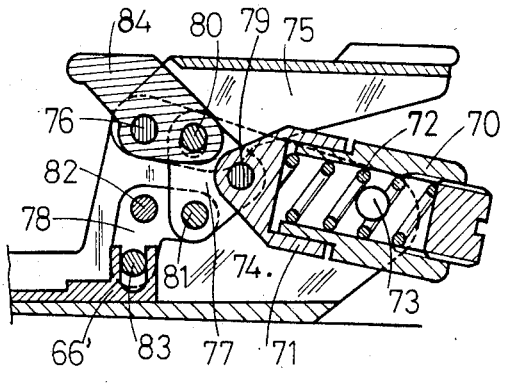
Figure 11:
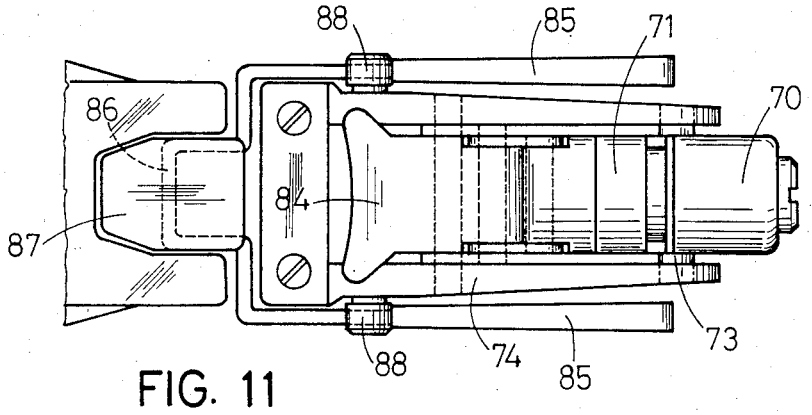

FIGS. 8 and 9 are views respectively in longitudinal cross section and in plan of another embodiment of the binding shown in closed position. FIGS. 10 and 11 are views respectively from the side partly in cross section and from above of the heel means of the binding according to FIGS. 8 and 9 shown in open position.

Figure 12:
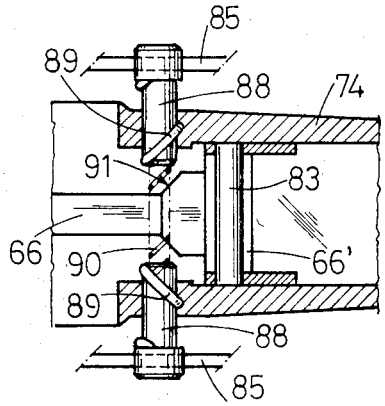
Figure 13:
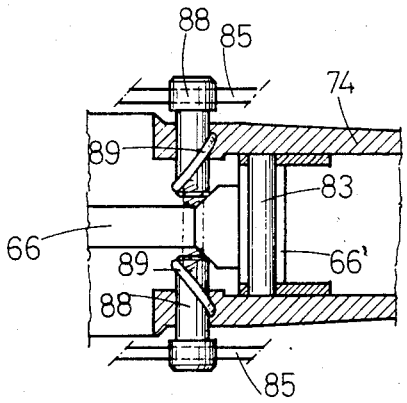

FIGS. 12 and 13 are partial horizontal cross sectional views of the step-in mechanism of the binding of FIGS. 8 and 9.

Figure 15:
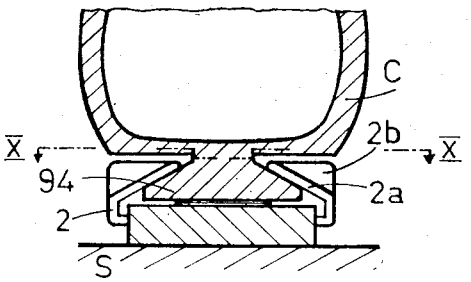
Figure 14:
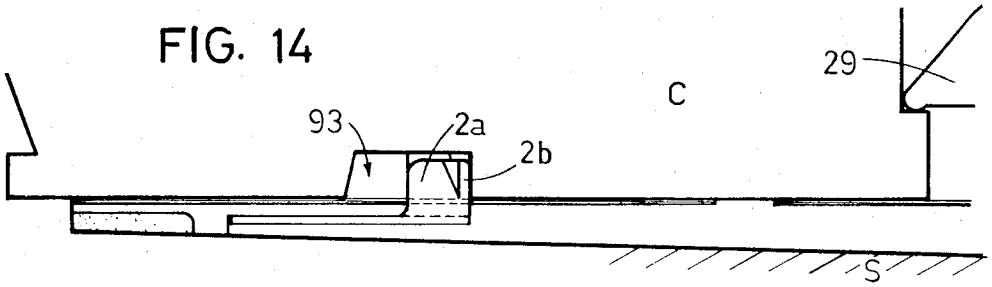
Figure 16:
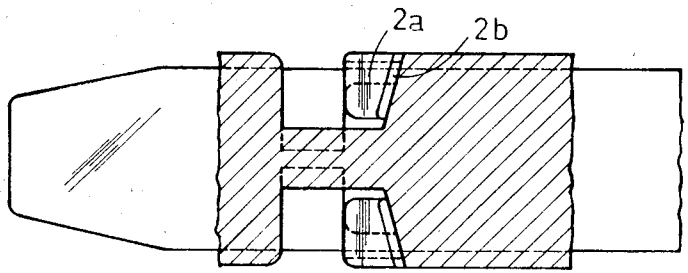

FIGS. 14, 15 and 16 are views respectively from the side, in transverse cross section and in plan (partially broken away along line X—X) of an embodiment of the lateral jaws of the binding.

Figure 17:
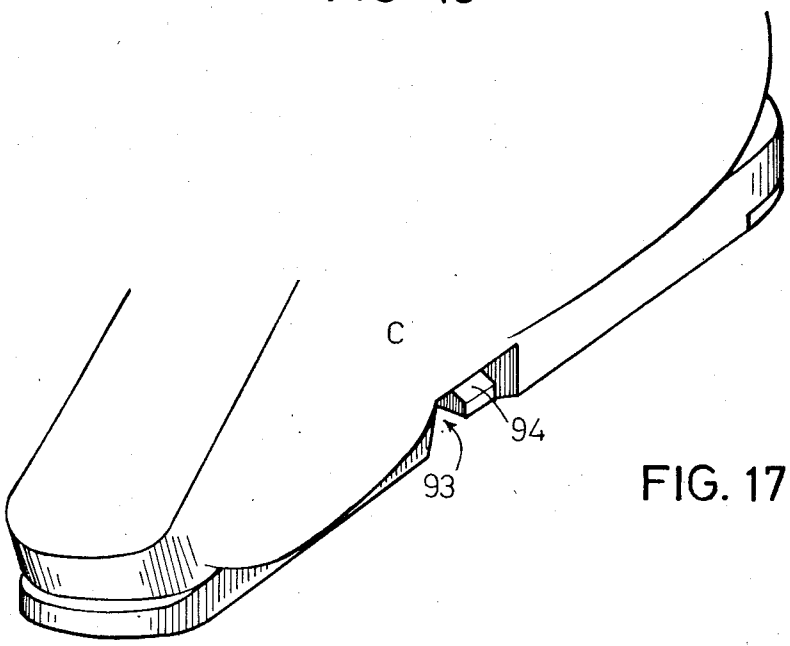
Figure 18:
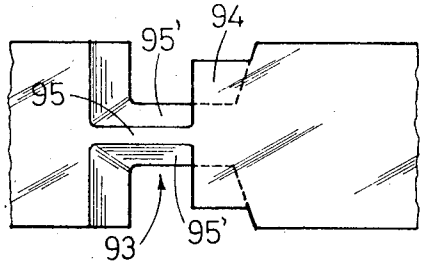

FIG. 17 is a view partially in perspective of a boot adapted to be fixed on a ski by means of the binding according to the invention, and FIG. 18 is a fragmentary view from below of the sole of this boot.

FIGS. 19, 20, 21 and 22 are views respectively from the side and from above of a first and second embodiment of the support plate associated with the binding according to the invention.

Referring first to FIGS. 1 to 4, an embodiment of the binding according to the invention will be described in detail. This binding, secured for example by screws to the upper surface of a ski S, comprises two parts mechanically connected to each other, on the one hand a forward torsional retaining device 1 of the ski boot C and comprising particularly two lateral jaws 2 and on the other hand a rear longitudinal retention device 3 (for forward and backward falls) or heel means, which comprises particularly a housing 4, in which is mounted an elastic member 5, and an actuating lever 6 which serves also as clamping means for the heel T of the boot C in the service position on the ski.

The forward device 1 and rear device 3 are mechanically connected, such that the elastic member 5 that stores energy actuates the two devices and that the opening or closing of one of the devices effects the respective opening or closing of the other device, and vice versa.

Figure 1:
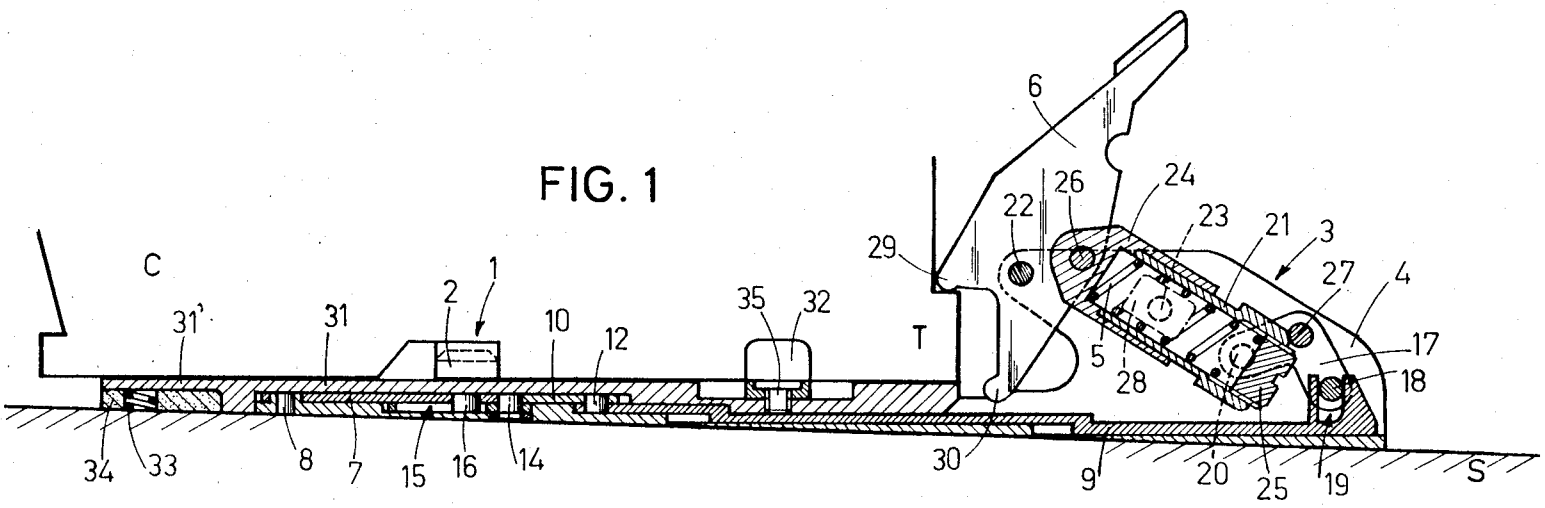
FIGS. 1 and 2 are views respectively in longitudinal cross section and in plan of an embodiment of the binding in closed service position.
Figure 2:
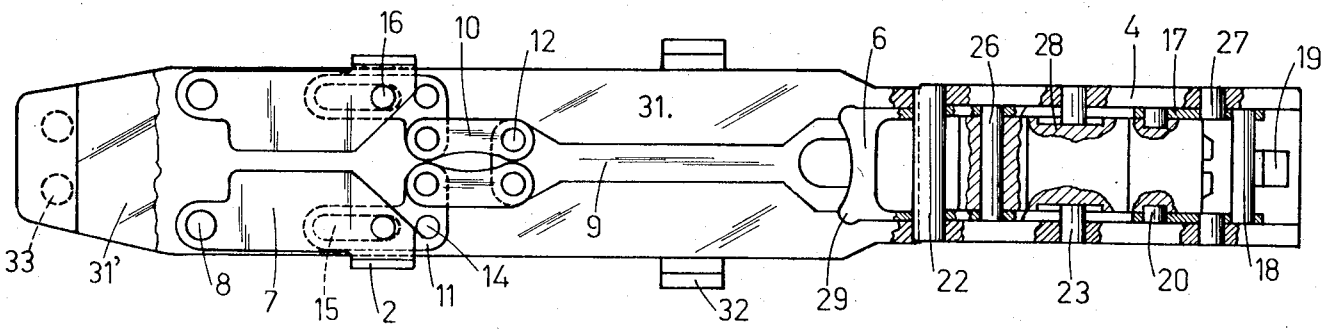
Figure 3:
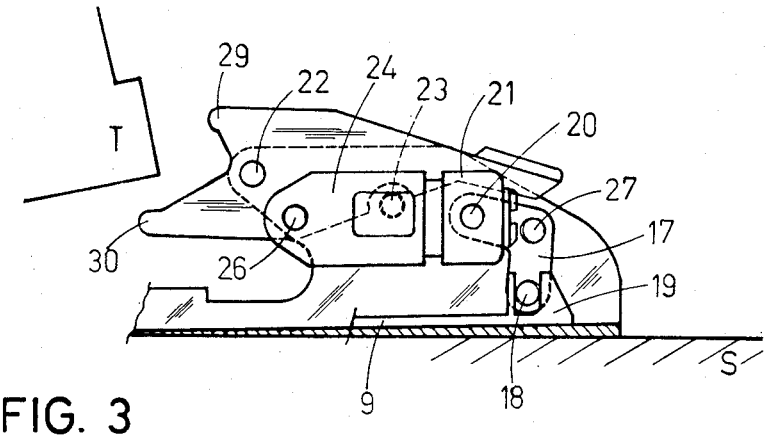
FIGS. 3 and 4 are views respectively from the side and in plan of the embodiment of FIGS. 1 and 2 in open position.
Figure 4:
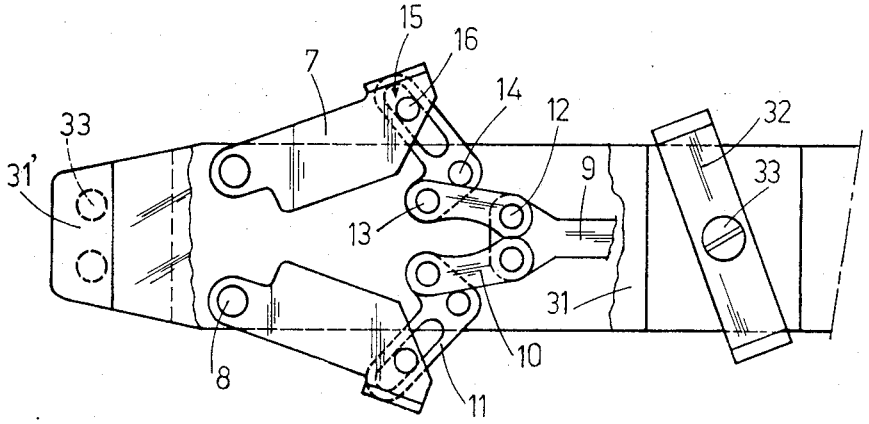
Figure 1:
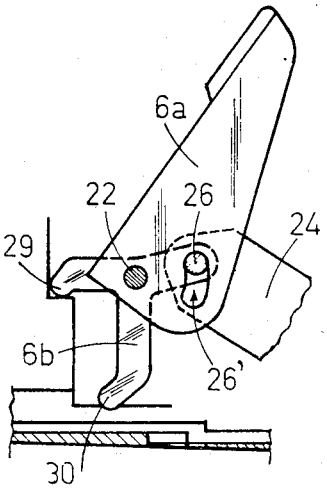

As shown in FIGS. 1, 2 and 4, the forward device comprises two arms 7 carrying the jaws 2 and pivotally mounted each about a vertical pivot so as to be displaceable parallel to the surface of the ski S between a closed service position (FIGS. 1 and 2), the jaws 2 clamping in this position the lateral edges of the middle portion of the ski boot C, and an open position (FIG. 3) in which said boot is freed. Said displacement is effected by the action of the elastic member 5 of the heel means 3 to which the arms 7 are connected by means of a longitudinally slidable strap 9.

The forward end of this strap 9 is connected to the arms 7 carrying the lateral jaws 2 by means of two pairs of levers 10, 11. Each pair of levers comprises a first straight lever 10 whose one end is articulated to the end of the strap 9 and whose other end is articulated to a second cranked lever 11, by means of pivot pins 12, 13. The lever 11 is mounted pivotably at the level of its cranked portion on a vertical pivot 14 secured to the upper surface of the ski and has an elongated opening 15 with which a pivot pin 16 secured to arm 7 coacts, so as to permit the lateral opening of the jaws 2 under the influence of longitudinal forward translational movement of strap 9.

The rear end of strap 9 is on the other hand connected to the elastic member 5 of the heel means 3 by means of cranked levers 17 whose one end is provided with a transverse axle 18 coacting with a fork 19 on the rear end of said strap 9. The other end of the cranked levers 17 is provided with a transverse axle 20 pivoted in one of the parts 21 of a spring housing which is part of heel means 3.

The rear device or heel means 3 comprises a housing 4 fixed on ski S in the walls of which is secured an axle 22 on which the actuating lever 6 is pivotally mounted. Moreover, the heel means 3 also comprises a spring housing mounted pivotally about two transverse axles 23 secured in the walls of housing 4, the spring housing being comprised by two parts 21, 24 sliding one within the other so as to act as a piston to compress the elastic member 5, in this case a helicoidal spring, the force of the latter being adjustable by means of an adjustment screw 25 accessible from the rear of the heel means 3. The other part 24 of the spring housing is pivoted on the lever 6 by means of an axle 26. Finally, the cranked levers 17 are pivotally mounted at the level of their cranked portion on axles 27 secured in the walls of housing 4.

In the wall of the part 24 of the spring housing articulated on lever 6 are provided two recesses 28, the fixed axles 23 of pivoting of said spring housing 21, 24 being situated in service position (FIG. 1) in the center of said recesses 28, whose dimensions are greater than those of said fixed axles 23.

Furthermore, the lever 6 has a sole grip 29, bearing in the service position on the upper edge of heel T of the ski boot C (FIG. 1) so as to maintain the latter on the ski S, in combination with two lateral jaws 2. The lever 6 also has an automatic engagement member ("step-in") whose operation will be described below.

Finally, in the illustrated embodiment, the safety binding comprises also a base plate 31 and a lateral guide member 32.

The base plate 31 is secured, for example by screws, on the upper surface of the ski S and is adapted to receive the movable mechanical members of the binding, particularly the arms 7 carrying the jaws, the actuating strap and the two sets of articulated levers 10, 11, and to receive on its upper surface the sole of the ski boot. This base plate 31 is characterized by having at its forward end a reduced deformable portion 31' subjected to an elastic action tending to maintain this part parallel to the surface of the ski S. In the illustrated embodiment, the elastic force is exerted by two small helical springs 33, the space between the upper surface of the ski and the deformable portion 31' being moreover filled with a plastic foam 34, preferably of flexible closed cells, so as to avoid the formation of ice or the presence of snow or other materials in this space. Preferably, at least the deformable portion 31' of the base plate 31 is provided on its upper face with a coating adapted to improve the coefficient of friction with the sole of the boot C, for example a coating of "Teflon".

The lateral guide member 32 is formed of a transverse strip pivotally mounted on the base plate 31 by means of a screw 35 passing through its center, the ends of the strip being bent substantially vertically so as to form centering wings.

In the closed service position shown in FIGS. 1 and 2, the elastic member 5 exerts its force on the transverse axes 20 and 26, and thus on the strap 19 by means of the levers 17 on the one hand and the lever 6 on the other hand. The same moment of force exerted by the spring 5 is therefore applied on the one hand to maintain the lateral jaws 2 in a position clamped against the sole of the ski boot C and on the other hand on the sole clamp 29 of the lever acting on the edge of heel T of said boot. In this service position, the axle 23 and the recesses 28 have no function.

As to the safety opening of the binding, its operation may be broken down into two movements according to the nature of the fall which triggers this opening; this breaking down is theoretical, because in reality it is only rarely that there is a purely forward fall or a purely twisting fall, the two types of forces being almost always combined and simultaneous.

Considering first the theoretical case of a purely forward fall, this is characterized by an upward movement of the heel T of the ski boot C and thus of the sole grip 29 of lever 6, the latter pivoting about the axle 22 while pressing the axle 26 rearwardly. During the first part of this movement, the spring 5 is compressed and the spring housing 21, 24 pivots about the axle 20; at the same time, the recess 28 provided in the part 24 of the spring housing is displaced downwardly. From the time the upper wall of the recess 28 comes into contact with the fixed axle 23, the spring housing 21, 24 thus pivots about this axle 23.

The movement then continues, by rotation of the lever 6 about the fixed axle 22 and the cranked levers 23 about the fixed axles 27, up to a so-called "overcenter" position in which the axles 22, 26, 20 and 27 are located substantially in a single plane. Once this overcenter position is passed, the mechanism is disposed in the open position shown in FIGS. 3 and 4.

In the open position, the lever 6 is roughly horizontal, the axle 26 being located below the fixed axle 22, and the heel T of the boot C is completely disengaged from the sole grip 29 of lever 6. Moreover, spring 5 is in its compressed position, while the axle 28 of the cranked levers 17 is located in front of the fixed pivotal axles 27 of these levers whereby the strap 9 will also be displaced forwardly and thus effects opening of the jaws 2 permitting the complete disengagement of the boot. The complete disengagement of the boot C is moreover nicely facilitated by the above described feature of the base plate 31 which has at its forward end an elastically deformable portion 31'. Thus, thanks to the fact that this portion 31' may be deformed by being collapsed as well longitudinally forwardly as transversely from one side or the other downwardly, offering thus at the forward portion of the boot a favorable sliding slope, the scraping and wedging between the sole and the base plate are very greatly diminished and the disengagement of the boot facilitated.

Considering now the theoretical case of a purely twisting fall, and starting of course from the closed service position (FIGS. 1 and 2), the twisting movement of the boot C tends to open the jaws 2 and thus to advance the strap 9; during a first phase, this displacement effects pivoting of the cranked levers 17 about the fixed axles 27 and thus the compression of the spring 5, the spring housing 21, 24 pivoting first about the axle 26. Simultaneously, the recess 28 provided in the part 24 of the spring housing moves upwardly; as soon as the lower wall of the recess 28 comes into contact with the fixed axle 23, the spring housing 21, 24 then pivots about this axle 23. This movement effects the pivoting of the lever 6 about the fixed axle 22 up to the overcenter position described above. Once this overcenter position is passed, the axles 26 are moved to the position of FIG. 3, and the lever 6 then reaches its horizontal position permitting the heel T of the boot C to be disengaged from the pressure of the sole grip 29 of said lever 6.

In the open position shown in FIG. 3, the binding is ready to be automatically applied. Thus, the automatic boot-gripping member 30 (step-in), which is of one piece with the lever 6, may be actuated by downward pressure of the heel T of the boot C. By pressing on this control member 30 of the step-in, the lever 6 is pivoted about the fixed axle 22 and the axes 26 are moved upwardly thereby making the spring housing 21, 24 pivot about the axle 22 during a first stage. As soon as the lower wall of recess 28 enters into contact with the fixed axle 23, the spring housing 21, 24 pivots about this axle 23, and the axle 20 is moved downwardly to the overcenter position described above. Once this overcenter position has been passed, the binding automatically closes, which is to say that the strap 9 is displaced by the force of spring 5 rearwardly, which effects the gripping of the jaws 2, and that the sole grip 29 of the lever 6 comes to bear against the upper edge of the heel T of the ski boot C (FIG. 1).

The difference in size between the recesses 28 and the fixed axles 23 provides a play permitting the use of the binding even with an added thickness of snow or ice, beneath the sole, laterally between the jaws and the sole or rearwardly between the latter and the sole grip of the heel means, this play serving thus automatically to compensate said added thickness.

In the embodiment described above with reference to FIGS. 1 to 4, the mechanism of the strap 9—levers 10, 11—arm 7— jaws 2 is analogous to that described in patent applications EP No. 0 084 813 and EP No. 0 085 313, except for the fact that the arms 7 are pivoted on the axles 8 located in front of the jaws 2.

Of course, other opening-closing mechanisms of the lateral jaws may be used in the present invention than those described above by way of example, for example a mechanism with retractable jaws such as that described in French patent No. 2,420,358.

As to the heel means comprising an elastic member for the storage of energy and a lever combined with a sole grip member, it may be also different from that described above by way of example.

As shown in FIG. 1', the actuating lever may be formed of two parts **6*a*, 6*b* both pivotally mounted on the fixed axle 22 on the one hand and coacting on the other hand with the axle 26 fixed to the spring housing 24. The upper part 6*a* of the lever comprises also an opening 26' in which said axle 26 may move, whereby there will be play between the two parts 6*a* and 6*b* permitting the upper part 6*a* of the lever to be, in the open position of the binding, no longer in a horizontal position, as shown in FIG. 3, but slightly inclined upwardly relative to this position, the axle 26 being then in abutment with the lower wall of the opening 26'**.

A first modification of the heel means is illustrated in FIGS. 5 and 6. In this embodiment, the lever 36 is articulated to the end of one of the arms of cranked levers 37 by means of transverse axles 38, the levers 37 being pivotally mounted at the level of their cranked portion on axles 39 fixed transversely in the walls of a main housing 40. These levers 37 comprise moreover an axle 41 cooperating with a fork 19 which is on the rear end of the strap 9, this strap being, as before, adapted to effect the opening and closing of the lateral jaws (not shown).

Moreover, a spring housing formed in two parts 42, 43 sliding one in the other and containing a helical spring (not shown) is pivotally mounted by its rear portion 42 about axles 44 fixed in the walls of the main housing 40. The forward part 43 of the spring housing is articulated on the lever 36 by means of a transverse axle 45.

The description of the operation of this first modification will, as before, be broken down according to two theoretical types of falls.

In the case of a theoretical purely forward fall, and under the vertical force of the boot C, the sole grip member 46 of lever 36 will be pressed upwardly and causes the lever 36 to pivot about axles 38 of levers 37 causing the compression of the elastic member contained within the spring housing 42, 43; the movement continues until the time the axles 38, 45 and 44 are disposed in a single plane, which is to say in said "overcenter" position. Once this position is passed, the mechanism is in the open position (FIG. 6) in which the axles 45 are located below the plane passing through the axles 38 and 44, the actuating strap 9 of the lateral jaws being then moved to its forward open position.

In the case of a theoretical purely twisting fall, the strap 9 moves forwardly under the action of the opening of the jaws causing the levers 37 to pivot on the axles 39. In the process, the levers 37 transmit their force to the lever 36 via axle 38, to make it pivot about this axle, and act on the axle 45 to compress the spring contained in the spring housing 42, 43; this movement continues until the overcenter position described above is reached, then the open position (FIG. 6).

For the deliberate opening of the binding, the mechanism acts initially by applying force downwardly on the lever 36 (for example with the end of a ski pole) in the same way as in the case described above for a purely forward fall.

Next, a stop 47 mounted on lever 36 comes into contact with fixed axle 39. From then on, the levers 37 and the lever 36 are unitary and pivot together about the axle 39 to the overcenter position in which the axles 39, 38, 45 and 44 are located in a single plane; once this overcenter position is passed, the mechanism reaches the open position shown in FIG. 6.

As to automatic donning of the binding (step-in), this happens as soon as the heel T of the boot C presses against the step-in member 48 of lever 36 so as to cause the latter to pivot with the levers 37 which are fixed to it about the axle 39, into abutment against the stop 47; thus, by pivoting, the above overcenter position is achieved in the opposite direction, and the mechanism then moves in such a way that the closed service position will be achieved (FIG. 5), which is to say with the sole grip 46 of the lever 36 bearing on the upper edge of the heel T of the boot C, the strap 9 being simultaneously displaced rearwardly so as to close the lateral jaws (not shown) on the edges of the sole of said boot.

In the second modification shown in FIG. 7, in the service position, the lever 50 is pivotally mounted directly on the axle 51 fixed to the walls of the main housing 52 and is provided with an axle 53 cooperating with the fork 19 on the rear end of the actuating strap 9 of the lateral jaws (not shown). Moreover, a spring housing, formed as in the first modification, of two parts 54, 55 sliding one within the other and containing a spring (not shown) for storing energy, is pivotally mounted by its rear part 55 on an axle 56 fixed in the walls of housings 52, the forward part 54 of this spring housing being pivoted on the lever 50 by means of an axle 57.

A sole grip element 58 is pivotally mounted on fixed axle 51, the pivotal movement of this member being limited by the presence of an abutment 59 fixed to the lever 50. Moreover, the lever 50 is also provided with a gripping finger 60 subjected to the action of a spring 61, whose force may be adjusted by means of a nut 62; the finger 60 slides obliquely on the lever 50 so as to come into service position bearing under the action of spring 61 against the sole grip member 58, which itself bears on the upper edge of the heel T of the ski boot C.

The operation of this second modification is analogous to that of the preceeding embodiments, the overcenter position being attained when the axles 51, 57 and 56 are located in the same plane. In the theoretical case of a purely forward fall, the force tending to raise the heel T acts during a first stage on the finger 60 by means of the sole grip 58. It is only when the finger 60 is completely retracted against the action of the spring 61 and the sole grip 58 comes into abutment against the lever 50, that the latter begins to pivot about the fixed axle 51 and to displace the pivotal axle 57, compressing the spring housing 54, 55, to the overcenter position. As before, the open position is achieved once the overcenter position is passed.

The embodiment illustrated in FIGS. 8 to 10 differs from that shown in FIGS. 1–4 by several structural features.

First of all, as concerns the lateral gripping mechanism, the latter comprises jaws 62 carried by arms 63 whose pivot axle 64 on the upper surface of ski S is located rearwardly of said jaws 62. Each of the jaws 62 has a forward lug **62*a* and a rear lug 62*b*, coacting in the closed service position (see FIG. 1**) with compressions corresponding to the shape of said lugs and which are on the sole of the ski boot C.

As before, the lateral jaws 62 are connected to heel means 65 by a strap 66 and a system of articulated levers 10, 11. In the same way, the forward end 31' of the base plate 31 adapted to receive the boot C is recessed to provide a space filled with plastic foam 34; moreover, the upper face of this elastically deformable forward end 31' is provided with a sliding plate 67, for example of Teflon, promoting the disengagement of the ski boot C. Finally, a positioning abutment 68 is slidably longitudinally mounted forward of the base plate 31 and may be fixed in predetermined position by means of a set screw 69.

As to the heel means 65, it consists of a modification of that shown in FIGS. 5 and 6. In this embodiment, the spring housing, also formed in two parts 70, 71 sliding one within the other and containing a helicoidal spring 72, is pivotally mounted by its rear part 70 about axles 73 fixed in the walls of the main housing 74 of the heel means 65. The forward part 71 of the spring housing is pivoted on the actuating lever 75 mounted pivotally on an axle 76 fixed transversely in the walls of the housing 74 of the heel means 65, by means of a triangular lever 77.

The triangular lever 77 is thus articulated at its corners on the forward end of the rear part 71 of the spring housing, on the actuating lever 75 and on one of the ends of the cranked lever 78, by respective pivotal axles 79, 80, 81. The cranked levers 78, serving as rockers, are pivoted on axles 82 fixed in the walls of the housing 74, and comprise at their other end a transverse axle 83 disposed in a fork 66' carried at the rear end of strap 66.

Moreover, a sole grip member 84 is fixed to lever 75 and pivots with it about axle 76; this sole grip member 84 is also secured to said lever 75 by axle 80, however there is play between this axle 80 and the sole grip member 84 (in phantom line in FIG. 8) thereby to permit, as in the previous embodiments, the operation of the binding even in the presence of a thin layer of ice or snow between the sole of the boot C and the base plate 31, namely between the sole grip member 84 and the upper edge of heel T.

Finally, this embodiment comprises also automatic donning mechanism ("step-in") combined with a brake or stopper. The latter is formed by two lateral branches 85 connected by a loop spring 86, the latter being surmounted by a horizontal pressure plate 87. The lateral branches 85 are maintained on each side by two cylindrical axles 88 mounted transversely in the lateral walls of housing 74. Each cylindrical axle 88 has on its external surface a helical rib 89 coacting with a groove provided in the interior of the passage through the wall of housing 74, whereby the axles move transversely in the passages provided in the walls of housing 74 while turning on themselves.

The operation of this embodiment is the same as in the case of the embodiments already described. The axles 81 and 82 of the cranked lever 78 move parallel to the axles 76 and 80, and the overcenter position between the closed service position (FIG. 8) and the open position (FIG. 10) is achieved when the axles 81, 82 and 76, 80 are in the same approximately horizontal plane.

As to the step-in mechanism, it operates as follows:

In the open donning position, the cylindrical axles 88 are in the position farthest spaced from each other (FIG. 12) under the conjoint action of the loop spring 86 and a spring 90 disposed transversely between the two axles 88; in this open position, the lateral branches 85 are directed outwardly of the ski and projected beneath the sole of the latter, while the loop 86 and the plate 87 are above the upper surface of the ski. As soon as pressure is exerted on the bearing plate 87 by pressure of the heel of the ski boot, the cylindrical axles 88 are pressed toward each other by the pivoting of the branches 85 and against the action of spring 90 until the internal ends of the two axles 88 come into abutment against an incline 91 of the strap 66 (FIG. 13); if the pressure is increased, the cylindrical axles 88 bearing against this incline 91 tend to push the lever 77 to the rear until the overcenter position is exceeded, which causes the closing of the jaws 62 on the sole of the boot C and the bearing of the sole grip member 84 against the heel T of the latter.

In all the embodiments of the binding according to the invention described with reference to the accompanying drawings, there is therefore provided a system permitting compensating the play necessary in order that the binding, and more precisely not only the lateral jaws but also the sole grip of the heel means, may be closed effectively on the ski boot even in the presence of a thin layer of snow or ice for example on the sole of said boot.

In FIGS. 14 to 16 is shown a preferred embodiment of the lateral jaws, in which each of these jaws has two distinct parts; on the one hand a forward part 2*a* bent inwardly and forming upwardly an acute angle of about 30° relative to the plane of the ski, and on the other hand a rear part 2*b* substantially vertical and forming with the longitudinal axis of the ski an angle of about 70°.

The forward part 2*a* of the jaws is adapted to ensure the lateral maintenance of the boot (against torsional forces), and to maintain the boot C on the ski against the forces of rear falling on the one hand and partially of forward falling (in combination with the sole grip 29 of the heel means). As to the rear part 2*b*, it plays the role of longitudinal centering means for the boot C opposite the sole grip 29 of the heel means; this substantially vertical rear part 2*b* does not hinder the disengagement of the boot in case of a purely forward fall, because the jaws in this case diverge outwardly to permit the immediate disengagement of the boot forwardly.

FIGS. 17 and 18 show an embodiment of the ski boot C, whose sole has at its median portion an impression forming an opening 93 and a lug 94, the latter having a face inclined at about 30° upwardly and inwardly. The impression is preferably provided during manufacture of the sole, and the inclined face of the lug 94 is adapted to coact with the part 2*a* of the gripping jaw of the binding. Moreover, the impression 93 provided in the sole also has a longitudinal rib 95 with conical walls 95' on each side, whose inclination is upwardly outwardly (see FIG. 18), having thus a transverse cross section in the form of a V. In case of opening of the lateral jaws, the conical walls 95' function to facilitate the ejection of the jaw 2 following the disengagement of the latter from the lug 94, the forward lug of the forward portion 2*a* of said jaw coming in effect into engagement with the conical wall 95'.

Figure 19:
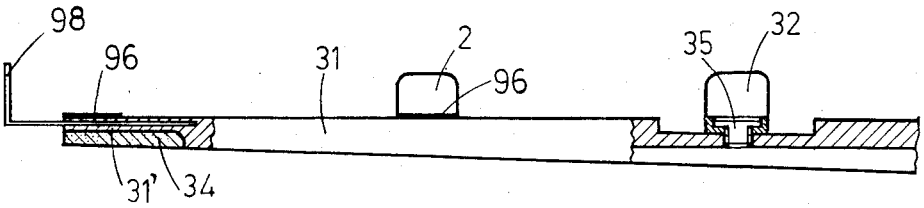
Figure 20:
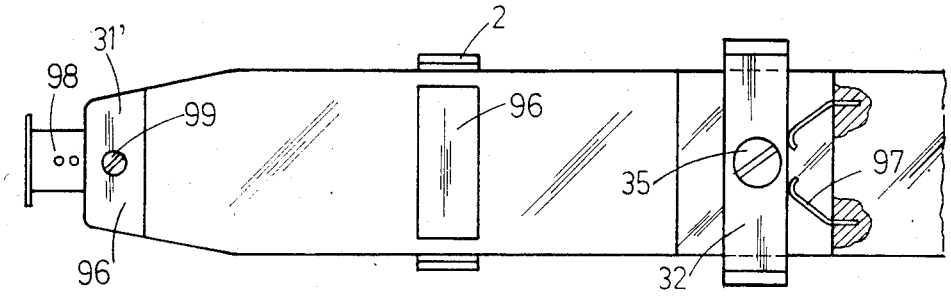

In FIGS. 19 and 20 is shown a first modification of a support plate 31. In this modification, the support plate 31 is provided with "Teflon" plates 96 fixed on its upper surface, more particularly at the level of the lateral jaws 2 and on its forward end. At least the forward portion 31' of the support plate 31 is made of spring material, of the type "Delrin" for example, whereby this recessed portion 31' is flexible and deformable as a leaf spring. Moreover, the lateral guide element 32 mounted pivotally on a screw 35 is subjected to the action of two leaf springs 97. Finally, an adjustable abutment 98 is mounted longitudinally slidably at the front of the support plate 31, a set screw 99 coacting with openings provided in the horizontal portion of this abutment 98. This abutment 98, whose adjustment is effectuated as a function of the size of the boot to be secured to the ski, is uniquely adapted to facilitate for the skier the longitudinal positioning of the boot on the binding.

In this modification, the sole of the boot (not shown) rests therefore on three slightly raised surfaces, namely the two "Teflon" plates 96 and the lateral guide element 32. Scraping with the sole is therefore limited to these three surfaces, and the disengagement of the boot in case of combined twisting-forward and twisting-rearward falling is facilitated. Moreover, the possibility of elastic deformation downwardly and laterally of the forward portion 31' of the support plate 31 permits decreasing the lever arms and thus decreasing the combined couple by about 20% relative to a known support plate which is not elastically deformable.

Figure 21:
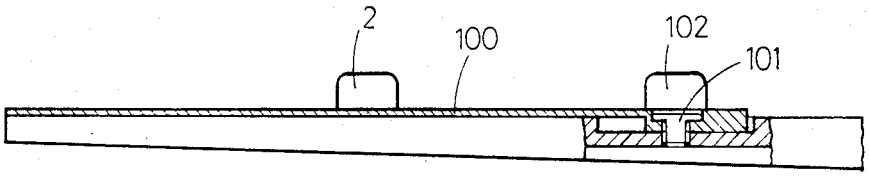
Figure 22:
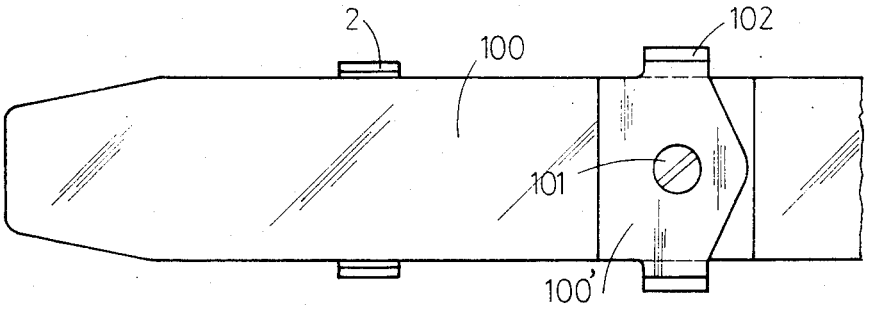

Finally, in the second modification illustrated in FIGS. 21 and 22, the support plate 100 is pivotally mounted about a screw 101 provided at the rear of said plate, this rear portion 100' being moreover provided with lateral wings serving as lateral guide elements. Thus, in case of twisting, the boot may be easily disengaged by the pivoting of the entire plate 100 covering the actuating mechanism of the lateral jaws 2. The pivoting support plate 100 is automatically returned to position by the jaws 2.

Compared to known safety bindings, that of the invention has greater reliability particularly in the cases, statistically the most frequent, of combined twisting-forward fall and twisting-rearward fall. This greater reliability is due to the fact that the forces acting on the binding, which is to say the torsion couple on the lateral jaws and the vertical force on the sole grip member, are additive to effect opening of the binding, while in the known bindings they are opposed, the forward overload for example rendering more difficult the opening of the forward abutment.

The binding according to the invention therefore permits a very great reduction of the sum of the forces suffered by the leg of the skier during falls called "combined forward or rear with torsion" due to the fact that the different components of the torsional and forward fall opening forces for example, share the work of unlocking a single retainer mechanism and not two as in the case of a known binding with forward abutment and heel means. Thus, the forward falling forces effect the opening of the heel means, leading also to the opening of the jaws of the retainer system in torsion, thereby reducing the torsional couple by the same amount. It can even be concluded that, in case of combined forward and twisting fall, the retaining forces in both forward and twisting directions are both lower than the nominal value since each of them participates in the opening of the other.

Moreover, the mechanism used is simple, compact and comprised by relatively few pieces. The wedgings possible on the boot, for example during bending of the ski, are greatly diminished. Moreover, the presence of a single compression spring, acting substantially simultaneously on the lateral jaws and the heel means, permits simplifying the operation of adjusting the binding. Finally, the binding according to the invention has the advantage commercially, and also with a view toward its use for rental skis, that the binding mechanism comprises three gripping zones, namely two lateral and one rear zone, for permitting donning on the same binding installed on a ski, of boots of different sizes. Only the distance between the heel means and the lateral jaws should be standarized and corresponds to that between the heel and the lateral lugs of the sole of the boots.

We claim:

1. Safety binding of a boot on a ski comprising two lateral jaws mounted displaceably under the action of elastic means between a closed service position in which these jaws coact with the sole of the boot and an open position, means interacting with the heel of a ski boot, said interacting means having a sole grip member mounted displaceably under the action of the same elastic means between a service position in which said member maintains the rear end of the sole of the boot on the ski and an open position, the whole being so arranged that the opening or the closing of the lateral jaws effects the opening or the closing, respectively, of the sole grip member, and vice versa, each lateral jaw being carried by an arm mounted pivotally on an axle perpendicular to the plane of the ski and being connected to levers pivoted at one end of a longitudinally slidable strap, the other end of the strap coacting with a rocker provided by the interacting means and which is subjected to the action of the elastic means, whereby this rocker has two stable positions corresponding to the service and open positions respectively of the binding, the sole grip member of the interacting means being secured to a lever pivotally mounted on a transverse axle and parallel to the plane of the ski and being subjected to the action of the elastic means to exert only a downward force on the sole of the boot, the elastic member comprising a spring housing formed in two respectively forward and rear parts sliding one within the other and containing a compression spring, the rear part of this spring housing being pivotally mounted on a fixed transverse axle and the forward part of said housing being articulated on a first fixed corner of a triangular lever, a cranked member serving as said rocker pivotally mounted by its cranked portion on a fixed transverse axle and connected by one of its ends with said strap of the lateral jaws and articulated by its other end to a second corner of said triangular lever, said triangular lever being articulated by its third corner on a actuating lever, this lever being pivotally mounted on a fixed transverse axle.

2. Binding according to claim 1, characterized by the fact that the sole grip member is mounted pivotally with play relative to the lever.

3. Binding according to claim 1, characterized by the fact that the actuating lever has a nose disposed substantially horizontally in open position of the binding and serving as actuating means for donning.

4. Binding according to claim 1, characterized by the fact that it comprises a brake formed by two lateral branches connected by a loop spring, each branch being maintained by a transverse cylindrical axle mounted slidably and pivotally in a lateral wall of the heel means, whereby said branch pivots with the cylindrical axle between an active positon corresponding to the open position of the binding and in which it projects below the sole of the ski and a rest position corresponding to the closed position of the binding and in which it is disposed above and substantially parallel to the plane of the ski, and by the fact that the inner end of the cylindrical axles comes into contact with a portion of the actuating strap during passage from the active position of the branches to their rest position thereby to permit automatic donning.

* * * * *